US007548722B2

(12) United States Patent
Tsuji

(10) Patent No.: US 7,548,722 B2
(45) Date of Patent: Jun. 16, 2009

(54) SWITCHBACK TRANSPORT MECHANISM AND IMAGE FORMING APPARATUS PROVIDED THEREWITH

(75) Inventor: Masaru Tsuji, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 334 days.

(21) Appl. No.: 11/555,721

(22) Filed: Nov. 2, 2006

(65) Prior Publication Data

US 2007/0110489 A1 May 17, 2007

(30) Foreign Application Priority Data

Nov. 11, 2005 (JP) ..... 2005-327630

(51) Int. Cl.
*G03G 15/00* (2006.01)

(52) U.S. Cl. ..... 399/401; 399/306; 399/407

(58) Field of Classification Search ..... 399/401
See application file for complete search history.

(56) References Cited

U.S. PATENT DOCUMENTS 6,782,236 B2 8/2004 Sasaki et al.
2002/0070497 A1 * 6/2002 Morrison et al. ..... 271/186

FOREIGN PATENT DOCUMENTS

EP 536778 A1 * 4/1993
JP 58-207247 12/1983
JP 2003-104612 4/2003

* cited by examiner

*Primary Examiner*—Daniel J Colilla
*Assistant Examiner*—Allister Primo
(74) *Attorney, Agent, or Firm*—Renner, Otto, Boisselle & Sklar, LLP

(57) ABSTRACT

A switchback transport mechanism includes a first transport section, a second transport section, a third transport section, and a transport control section. The first transport section applies propelling force to a sheet in the guiding path. The second transport section applies propelling force to a sheet in the ejecting path. The third transport section has a first transport member and a second transport member placed so as to be attached to and detached from each other. The third transport section selectively applies propelling forces in a frontward direction and a backward direction to a sheet in the switchback transport path through the first and second transport members. The transport control section controls operations of the first, second, and third transport sections. The transport control section detaches the first and second transport members from each other in a time period when no sheet is being transported by the third transport section.

6 Claims, 10 Drawing Sheets

SWITCHBACK TRANSPORT MECHANISM AND IMAGE FORMING APPARATUS PROVIDED THEREWITH

CROSS REFERENCE

This Nonprovisional application claims priority under 35 U.S.C. § 119 (a) on Patent Application No. 2005-327630 filed in Japan on Nov. 11, 2005, the entire contents of which are hereby incorporated by reference.

BACKGROUND OF THE INVENTION

The invention relates to a switchback transport mechanism for switching back a sheet being transported along a transport path. The invention further relates to an image forming apparatus provided with such a switchback transport mechanism.

There has been a growth in the number of image forming apparatus provided with a switchback transport mechanism that switches back a sheet by transporting the sheet forwards and then backwards. In image forming apparatus with duplex-printing features, for example, a sheet, after passing through an image forming section, is switched back by a switchback transport mechanism and then guided again to the image forming section. Such image forming apparatus use various different methods devised of switching back a sheet by the switchback transport mechanism. JP S58-207247A discloses a switchback transport mechanism having a half-moon roller that is arranged along a switchback transport path for the purpose of facilitating sheet switching-back.

With the prior art mechanism, however, it is impossible to guide a sheet into a switchback section until an immediately preceding sheet is switched back and ejected out of the switchback section. This results in relatively long intervals at which a series of sheets to be successively switched back are transported, thereby preventing an image forming process from being speeded up.

In view of the foregoing problems, a feature of the invention is to provide a switchback transport mechanism that allows sheets to be transported, and switched back, with improved efficiency, and an image forming apparatus provided with such switchback mechanism.

SUMMARY OF THE INVENTION

A switchback transport mechanism according to an aspect of the invention switches back a sheet by guiding the sheet from a guiding path to a switchback transport path through a connecting point and then ejecting the sheet from the switchback transport path to the ejecting path through the connecting point. The mechanism includes a first transport section, a second transport section, a third transport section, and a transport control section. The first transport section applies propelling force to a sheet in the guiding path. The second transport section applies propelling force to a sheet in the ejecting path.

The third transport section has a first transport member and a second transport member, placed in such a manner as to be selectively attached to and detached from each other. An example of the first and second transport members is the combination of a first roller that has a circumferential surface with a cutout portion and a second roller placed in contact with the circumferential surface of the first roller. Another example of the first and second transport members is a pair of rollers pressed against each other and supported in such a manner that a first roller is detachable from a second roller.

The third transport section selectively applies propelling forces in a frontward direction and a backward direction to a sheet in the switchback transport path through the first and second transport members.

The transport control section controls operations of the first, second, and third transport sections. The transport control section detaches the first and second transport members from each other in a time period when no sheet is being transported by the third transport section. This is because a space formed between the first and second transport members reduces sheet transport failures even when two sheets are passing each other in the switchback transport path.

In switching back a sheet, it becomes unnecessary for the third transport section to apply propelling force to a sheet when a leading end of the sheet reaches the second transport section. In other words, a space formed between the circumferential surfaces of the first and second rollers does not prevent transport of the sheet. This allows guiding a sheet into the switchback transport path without waiting for a preceding sheet to be ejected out of the switchback transport path.

DETAILED DESCRIPTION OF THE INVENTION

Figure 1:
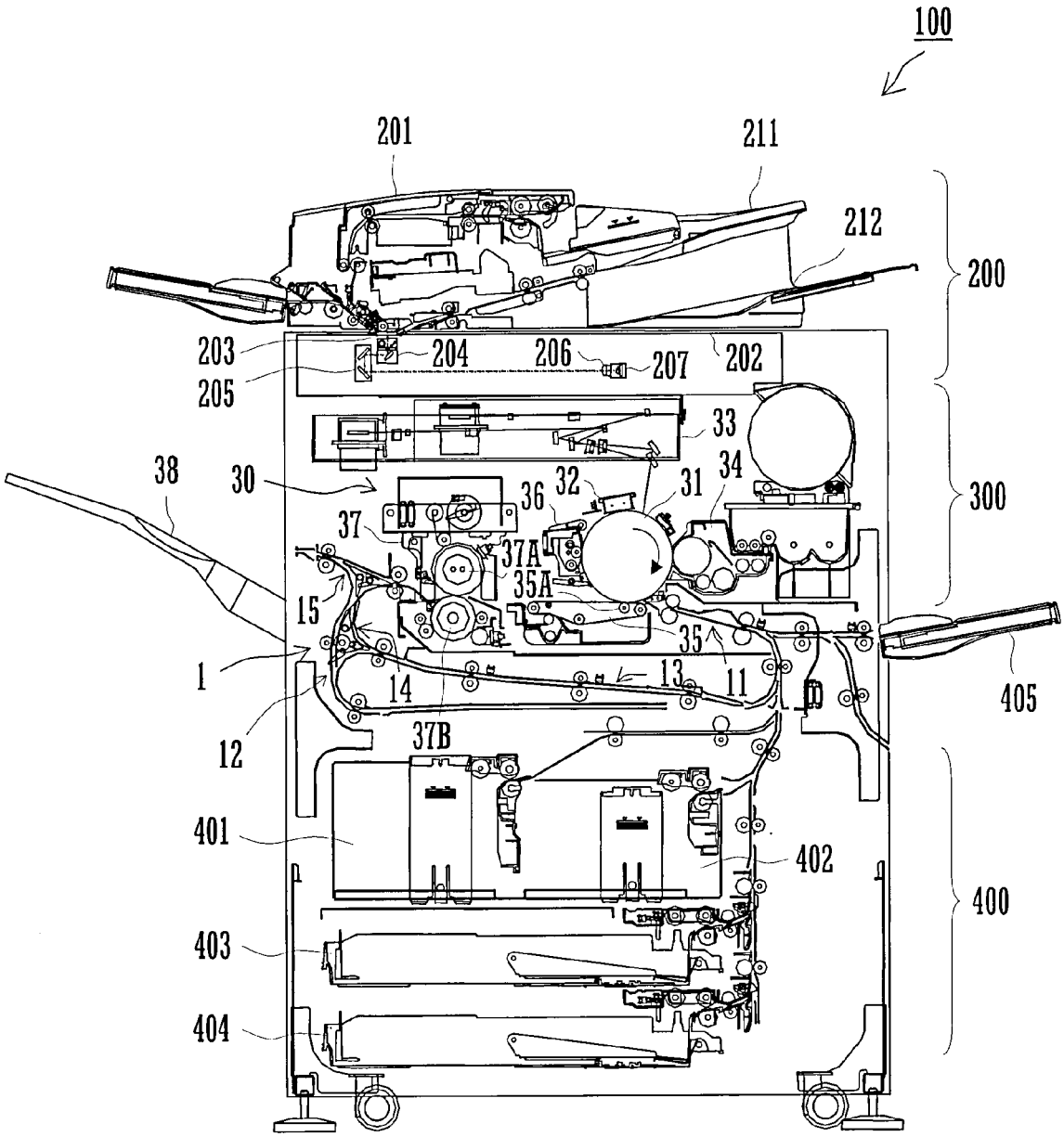
FIG. 1 is a view illustrating a schematic configuration of an image forming apparatus.

FIG. 1 is a schematic front cross-sectional view illustrating a configuration of an image forming apparatus according to an embodiment of the invention, such as an apparatus 100. The apparatus 100 includes an image reading unit 200, an image forming unit 300, and a sheet feeding unit 400.

The unit 200 has an automatic document feeder (ADF) 201, a first document platen 202, a second document platen 203, a first mirror base 204, a second mirror base 205, a lens 206, and a charge coupled device (CCD) 207.

The ADF 201 feeds an original document, sheet by sheet, from a document tray 211 to the platen 203. The ADF 201 serves as a document cover that covers the platens 202 and 203. Each of the platens 202 and 203 includes a hard glass plate.

The bases 204 and 205 are located below the platens 202 and 203. The bases 204 and 205 are supported reciprocally along a horizontal direction. The base 205 moves half as fast as the base 204 does. On the base 204, a light source and a first mirror are mounted. On the base 205, a second mirror and a third mirror are mounted.

In reading an image of original document that is being transported by the ADF 201, the base 204 is held still below the platen 203. In reading an image of original document placed on the platen 202, the bases 204 and 205 are moved horizontally below the platen 202.

In either case, light reflected from an image-bearing surface of the original document strikes the CCD 207 via the bases 204 and 205 and the lens 206. The CCD 207 outputs an electric signal according to an amount of light reflected from the image-bearing surface of original document. The electric signal is input to the unit 300 as image data.

The unit 300 is provided with an image forming section 30. The section 30 has a photoreceptor drum 31, a charging device 32, an exposure device 33, a developing device 34, a transfer belt 35, a cleaner 36, and a fusing device 37.

The drum 31, which has an outer photoreceptive surface, is rotatable in a direction indicated by an arrow in FIG. 1. The charging device 32 applies, to the surface of the drum 31, such a voltage as to allow the surface to have a uniform electric potential. The device 32 may be either a noncontact charger, or a contact charger of roller or brush type.

The exposure device 33 irradiates the surface of the drum 31 with light modulated according to image data, so that an electrostatic latent image is formed on the surface. As the device 33, a laser scanning unit is used in the present embodiment. Alternatively, a writing unit provided with an array of luminous elements such as ELs or LEDs may be used as the device 33. The developing device 34 supplies toner to the surface of the drum 31 to form a toner image on the surface.

Under the drum 31, the transfer belt 35 is looped over a plurality of rollers. The belt 35 has a resistance of $1\times10^{9}$ Ω·cm to $1\times10^{13}$ Ω·cm.

Positioned inside the loop of the belt 35 is a transfer roller 35A for transferring a toner image from the surface of the drum 31 to a sheet. The roller 35A is pressed against the drum 31 through the belt 35. A predetermined amount of transfer voltage is applied to the roller 35A when a toner image is to be transferred from the drum 31 to a sheet.

The cleaner 36 removes residual toner from the surface of the drum 31 after transfer of a toner image to a sheet. The fusing device 37 has a heat roller 37A and a pressure roller 37B. The roller 37A is provided with an internal heater for heating an outer surface thereof. The roller 37B is pressed against the roller 37A at a predetermined pressure. The device 37 heats and pressurizes a sheet passing between the rollers 37A and 37B, thereby fixing a toner image to the sheet. After passing through the device 37, the sheet is output to an output tray 38 mounted on a side surface of the apparatus 100.

The sheet feeding unit 400 corresponds to the sheet feeding section of the present embodiment. The unit 400 has sheet cassettes 401, 402, 403, and 404, and a manual sheet feeding tray 405. The unit 400 feeds sheets, one by one, to the section 30 from any one of the cassettes 401 to 404 and the tray 405.

Figure 2:
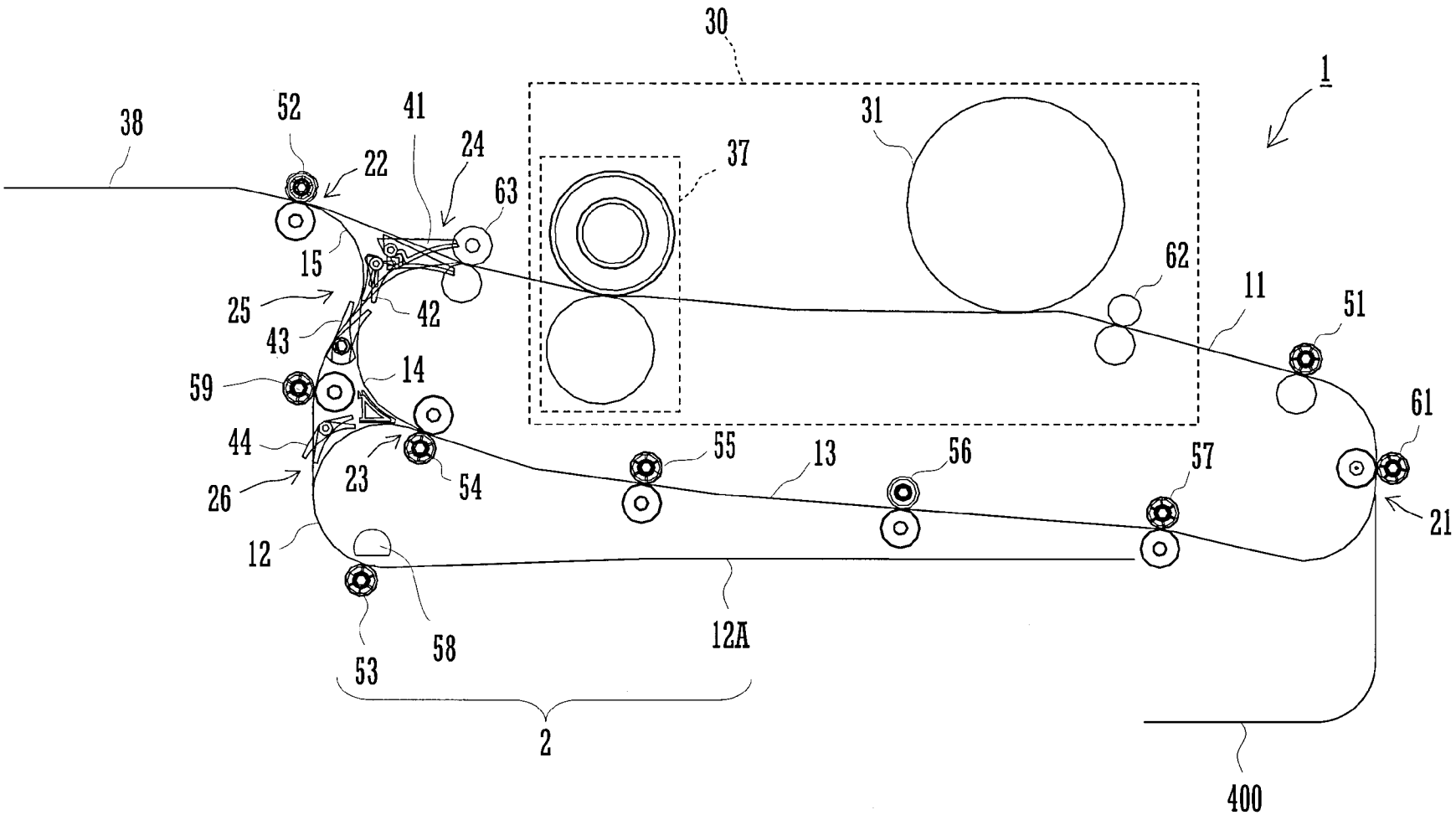
FIG. 2 is a diagram illustrating a configuration of a sheet transport path provided in the apparatus.

FIG. 2 is a diagram illustrating a configuration of a sheet transport path 1 provided in the apparatus 100. The path 1 is located inside the image forming unit 300. The path 1 includes a first path 11, a second path 12, a third path 13, a fourth path 14, and a fifth path 15. In the present embodiment, the paths 11, 12, and 13 correspond to the first path, the guiding path, and the ejecting path, respectively.

The path 11 leads from the unit 400 to the tray 38, through a first confluence 21, the section 30, a first bifurcation 24, and a second confluence 22 in that order. Arranged along the path 11 are transport rollers 61, 62, and 63, registration rollers 51, and output rollers 52.

The path 11 extends substantially horizontally in the section 30, for stable transfer of a toner image from the drum 31 to a sheet and for stable transport of a sheet carrying a prefusion toner image, to the device 37.

The path 12 guides a sheet from the bifurcation 24 to a first switchback section 2. The path 12 leads from the bifurcation 24 to the section 2, through a second bifurcation 25 and a third bifurcation 26 in that order. Transport rollers 59 are arranged with the path 12 sandwiched therebetween. The rollers 59 transport a sheet toward the section 2. The rollers 59 correspond to the first transport section of the present embodiment.

It is to be noted that, in the present embodiment, the first bifurcation 24 and the third bifurcation 26 correspond to the bifurcation and the connecting point, respectively.

The section 2 is provided with a switchback transport path 12A that extends substantially horizontally. Reversing rollers 53 and 58 are arranged with the path 12A sandwiched therebetween. The roller 58 is a half-moon roller. More specifically, the roller 53 has a circumferential surface with a flat portion oriented along a rotation axis thereof, and thus is half-moon shaped in cross section perpendicular to the rotation axis. As the roller 58, a conventional half-moon roller for general purpose use is usable. It is preferable that a circumferential length of the roller 58, excluding length of the flat portion, is longer than a distance between the bifurcation 26 and transport rollers 54. This allows a switched-back sheet to be delivered to the rollers 54 by rotating the roller 58 a turn in the backward direction.

In the configuration of the present embodiment, thus, the circumferential length of the roller 58, excluding the length of the flat portion, is longer than the distance between the bifurcation 26 and the rollers 54. It is to be noted that the roller 58 includes, but is not limited to, a half-moon roller. As the roller 58, any roller will suffice that has nonconstant distance between its rotation axis and its circumferential surface. In the present embodiment, the roller 58 corresponds to the first roller. The roller 53 is positioned in such a manner that a circumferential surface thereof is in contact with a portion of the circumferential surface of the roller 58 other than the flat portion. In the present embodiment, the roller 53 corresponds to the second roller.

The third path 13 leads from the third bifurcation 26 to the first confluence 21, via a third confluence 23. Along the path 13, transport rollers 54, 55, 56, and 57 are arranged. In the present embodiment, the rollers 54 to 57 collectively correspond to the second transport section. The fourth path 14 leads from the bifurcation 25 to the confluence 23. The fifth path 15 leads from the bifurcation 25 to the confluence 22.

Figure 3:
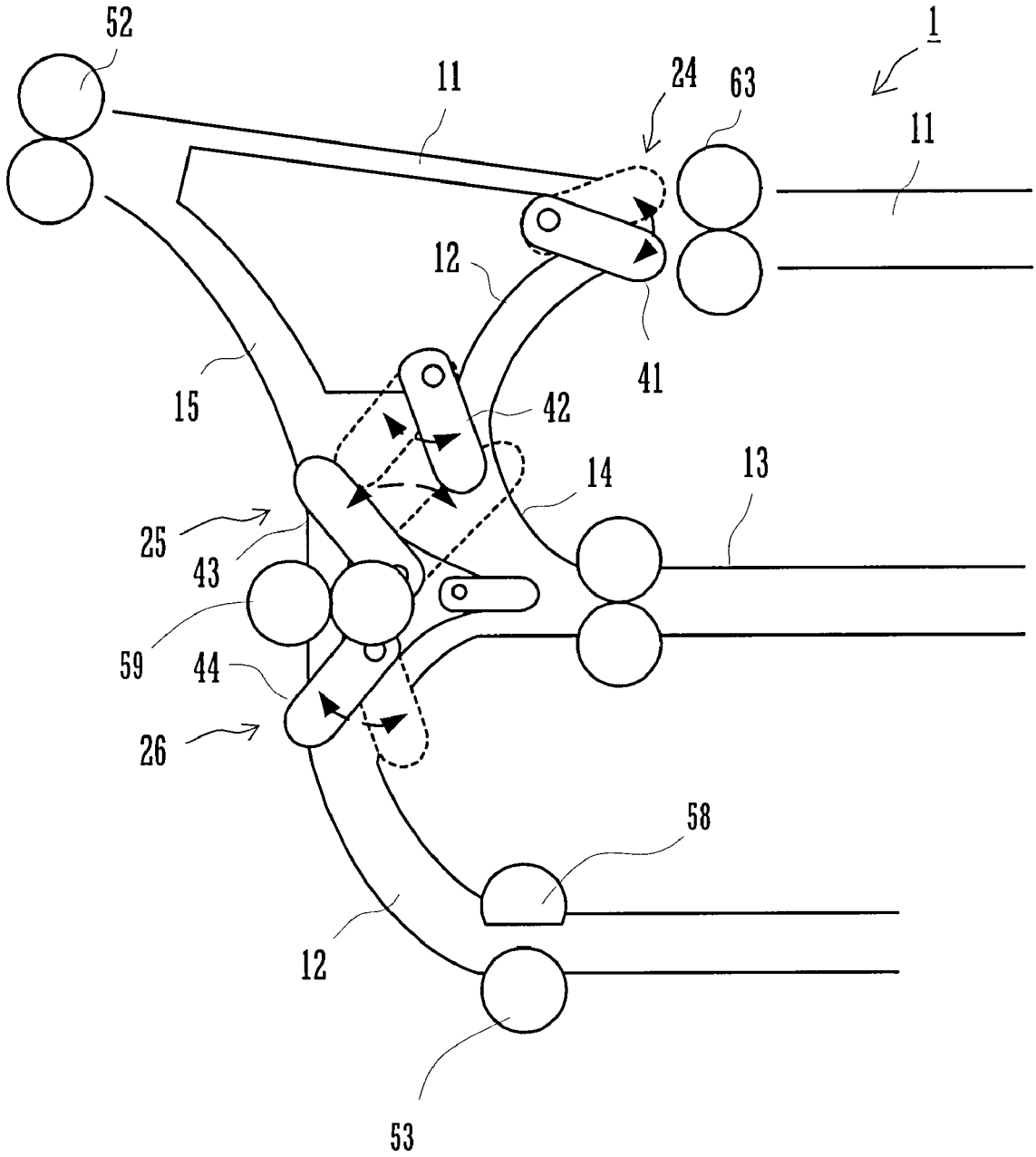
FIG. 3 is a schematic diagram illustrating a configuration of part of the sheet transport path near a switchback section.

FIG. 3 is a schematic diagram illustrating a configuration of the first bifurcation 24, the second bifurcation 25, and the third bifurcation 26, in the sheet transport path 1. A guide 41 is provided at the bifurcation 24. The guide 41 is selectively moved between two respective positions indicated by a solid line and a dashed line shown in FIG. 3, to guide a sheet on the path 11 to either one of the tray 38 and the section 2.

Guides 42 and 43 are provided at the bifurcation 25. With no external force acting thereon, the guide 42 is in a position, indicated by a solid line shown in FIG. 3, to guide a sheet being transported upward along the path 12 or the path 14, into the path 15. The guide 42 is moved to a position indicated by a dashed line shown in FIG. 3, by contact with a sheet that is being transported downward from the bifurcation 24 along the path 12. The guide 43 is supported pivotably between two respective positions indicated by a solid line and a dashed line shown in FIG. 3.

A guide 44 is provided at the bifurcation 26. The guide 44 is supported pivotably between two respective positions indicated by a solid line and a dashed line shown in FIG. 3.

Figure 4:
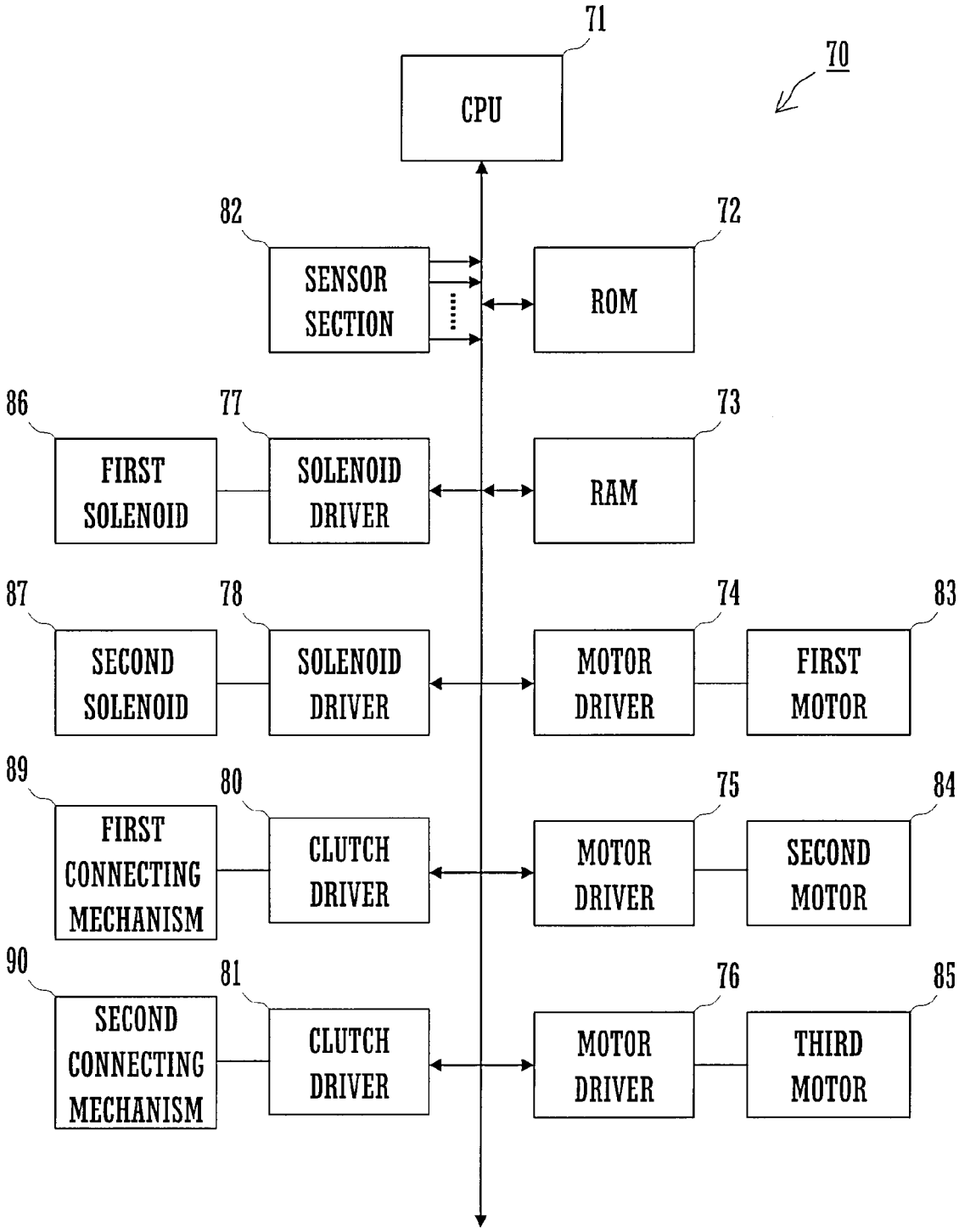
FIG. 4 is a block diagram illustrating a schematic configuration of the apparatus.

FIG. 4 is a block diagram illustrating a configuration of a control section 70 provided in the apparatus 100. In the present embodiment, the section 70 corresponds to the transport control section. The control section 70 has a CPU 71, a ROM 72, a RAM 73, motor drivers 74, 75, and 76, solenoid drivers 77 and 78, clutch drivers 80 and 81, and a sensor section 82.

The section 82 has a plurality of sensors arranged in the sheet transport path 1. The sensors detect presence of a sheet at respective different locations in the path 1 and send detection signals to the CPU 71 according to the detection results.

The CPU 71 executes programs prestored in the ROM 72. For example, the CPU 71 controls the motor drivers 74 to 76, the solenoid drivers 77 and 78, and the clutch drivers 80 and 81, according to the detection signals received from the section 82.

The driver 74 drives a first motor 83. The motor 83 is used to rotate the transport rollers 61 to 63, the registration rollers 51, the output rollers 52, and the transport rollers 59. The driver 75 drives a second motor 84. The motor 84 is used to rotate the reversing roller 58. The driver 76 drives a third motor 85. The motor 85 is used to rotate the transport rollers 54 to 57.

The driver 77 activates a first solenoid 86. The solenoid 86 actuates the guide 41. The driver 78 activates a second solenoid 87. The solenoid 87 actuates the guide 43.

The driver 80 activates a first connecting mechanism 89. The mechanism 89 is connected to each of the motor 84 and the roller 58. In a deactivated state, the mechanism 89 directly transmits rotation of the motor 84 to the roller 58, so that the roller 58 is rotated in a forward direction to guide a sheet into the section 2. In an activated state, meanwhile, the mechanism 89 transmits, to the roller 53, rotation in an opposite direction to a rotational direction of the motor 84. Thus, the roller 58 is rotated in a backward direction to eject a sheet from the section 2. Alternatively, a motor that is rotatable in forward and backward directions may be directly connected to the roller 58 in order to allow the roller 58 to be rotated in forward and backward directions.

The driver 81 activates a second connecting mechanism 90. The mechanism 90 is connected to each of the motor 85 and the rollers 54 to 57. In a deactivated state, the mechanism 90 directly transmits rotation of the motor 85 to the rollers 54 to 57. In an activated state, meanwhile, the mechanism 90 transmits, to the rollers 54 to 57, rotation in an opposite direction to a rotational direction of the motor 85.

The apparatus 100 selectively performs a face-up transport operation, a face-down transport operation, and a duplex printing operation. In the face-up transport operation, a sheet with an image formed on a single side is output to the tray 38, with the image-formed side facing upward. In the face-down transport operation, a sheet with an image formed on a single side is output to the tray 38, with the image-formed side facing downward. In the duplex printing operation, an image is formed on each side of a sheet.

When an original document is to be copied onto a sheet, the face-up transport operation is performed in which the sheet is output to the tray 38, with the image-formed side facing upward. This is because the operator is near the apparatus 100 and ready to check the copied image on the sheet.

In the face-up transport operation, the CPU 71 rotates the motor 83 through the driver 74. A sheet fed from the unit 400 is transported along the path 11 by the transport rollers 61 to 63, the registration rollers 51, and the output rollers 52. A toner image is formed on an upper side of the sheet while the sheet is being passed through the image forming section 30. The sheet is output to the tray 38 with the image-formed side facing upward.

Figure 5:
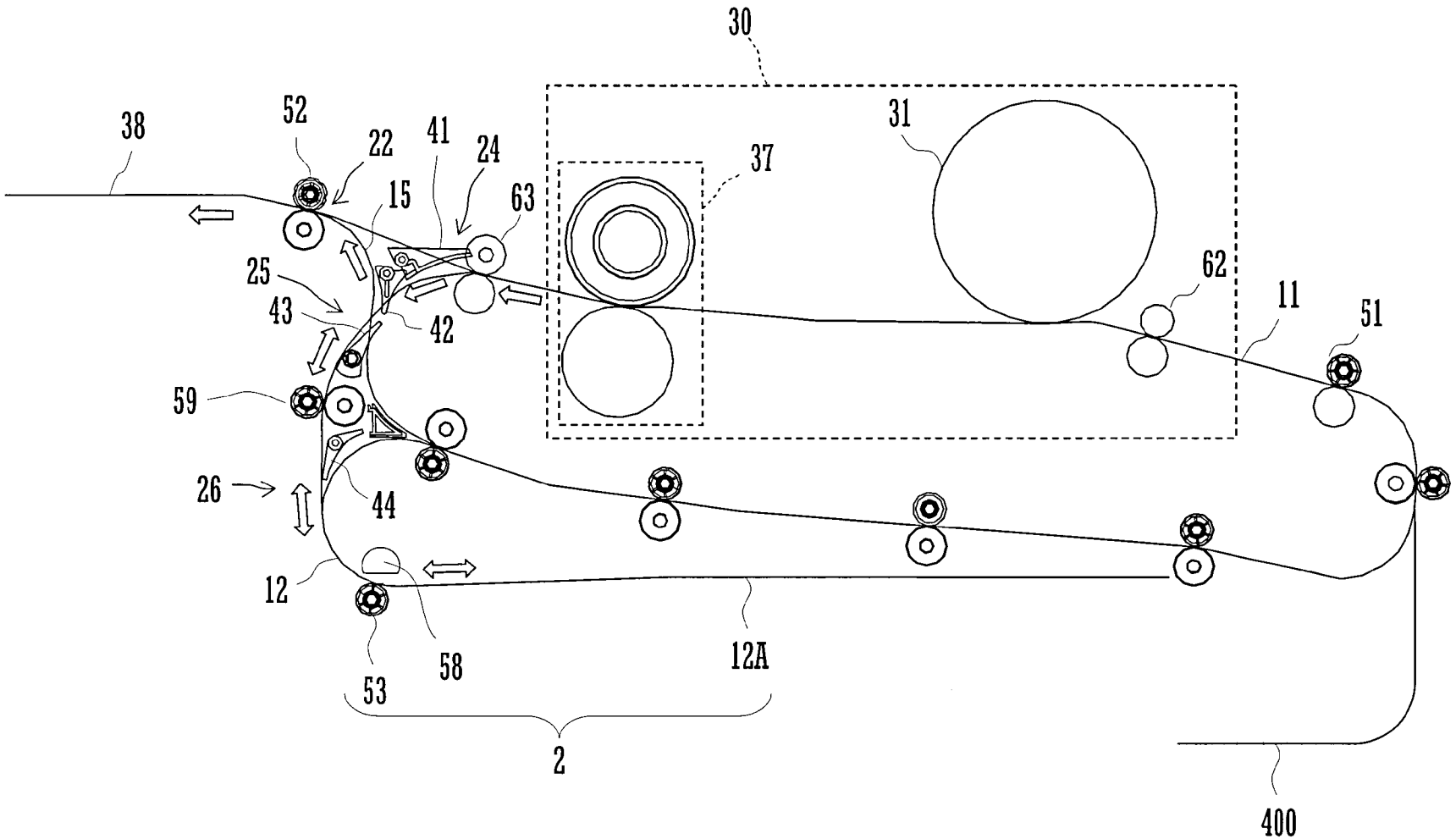
FIG. 5 is a schematic diagram illustrating an example of a first type of sheet transport operation.

FIG. 5 is a schematic diagram illustrating an example of face-down transport operation. In a case where the operator is not around the apparatus 100, the face-down transport operation is performed so that an image-formed side of the output sheet cannot be seen. When images on consecutive pages of an original document are to be formed on sheets of paper, the face-down transport operation is also performed for the purpose of eliminating the need for collating the pages of the output sheets.

In the face-down transport operation, a sheet, after passing through the section 30, is guided from the bifurcation 24 into the path 12. Subsequently, the sheet is switched back in the first switchback section 2, and then output to the tray 38 via the paths 12 and 15.

Figure 6:
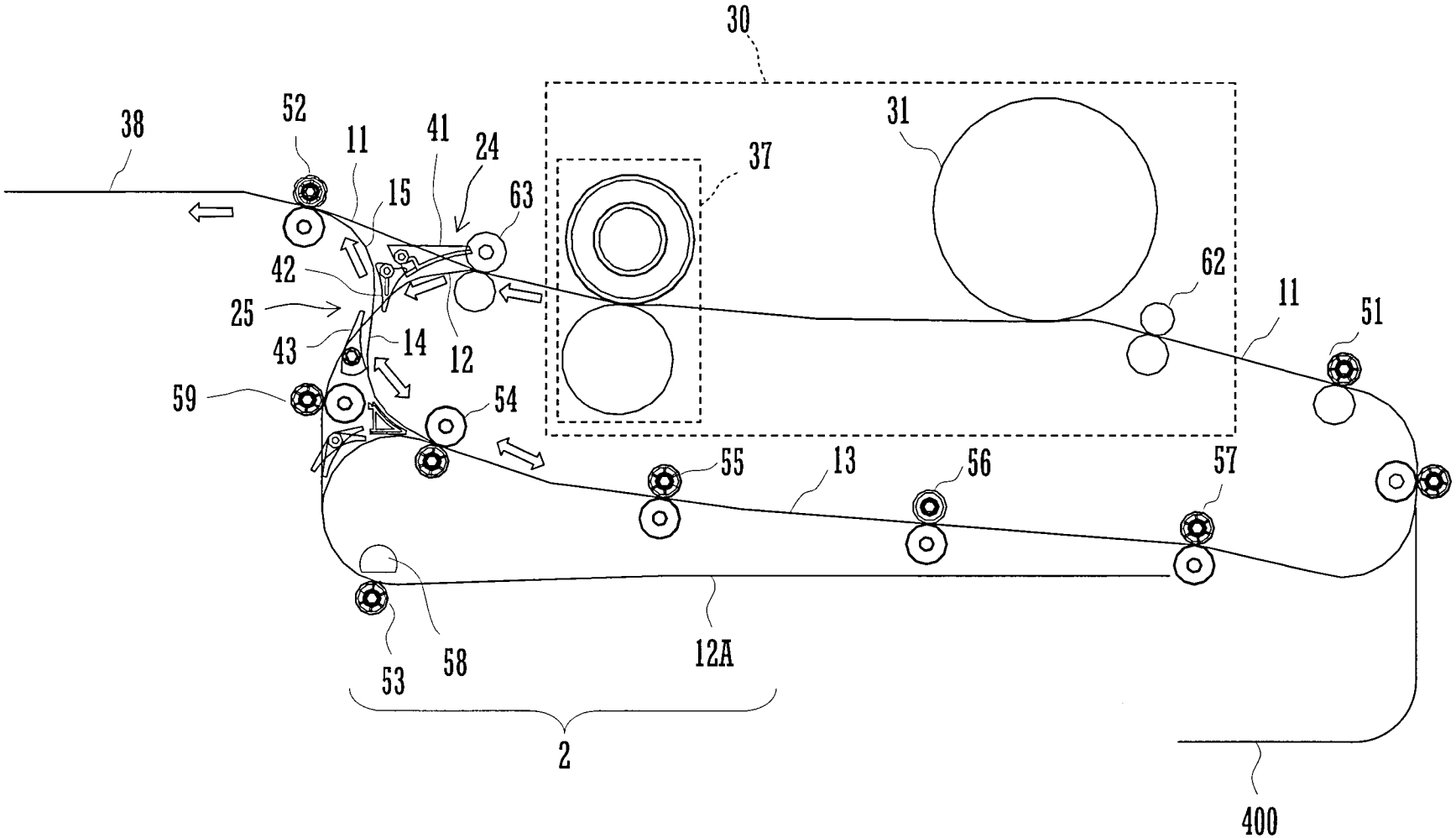
FIG. 6 is a schematic diagram illustrating another example of the first type of sheet transport operation.

FIG. 6 is a schematic diagram illustrating another example of face-down transport operation. Here too, a sheet, after passing through the section 30, is first guided from the bifurcation 24 into the path 12. Then, the sheet is guided into the path 13 via the path 14. Subsequently, the sheet is output to the tray 38, via the path 13 and then the path 15. In this example, the path 13 and the rollers 54 to 57 make up a second switchback section.

Figure 7:
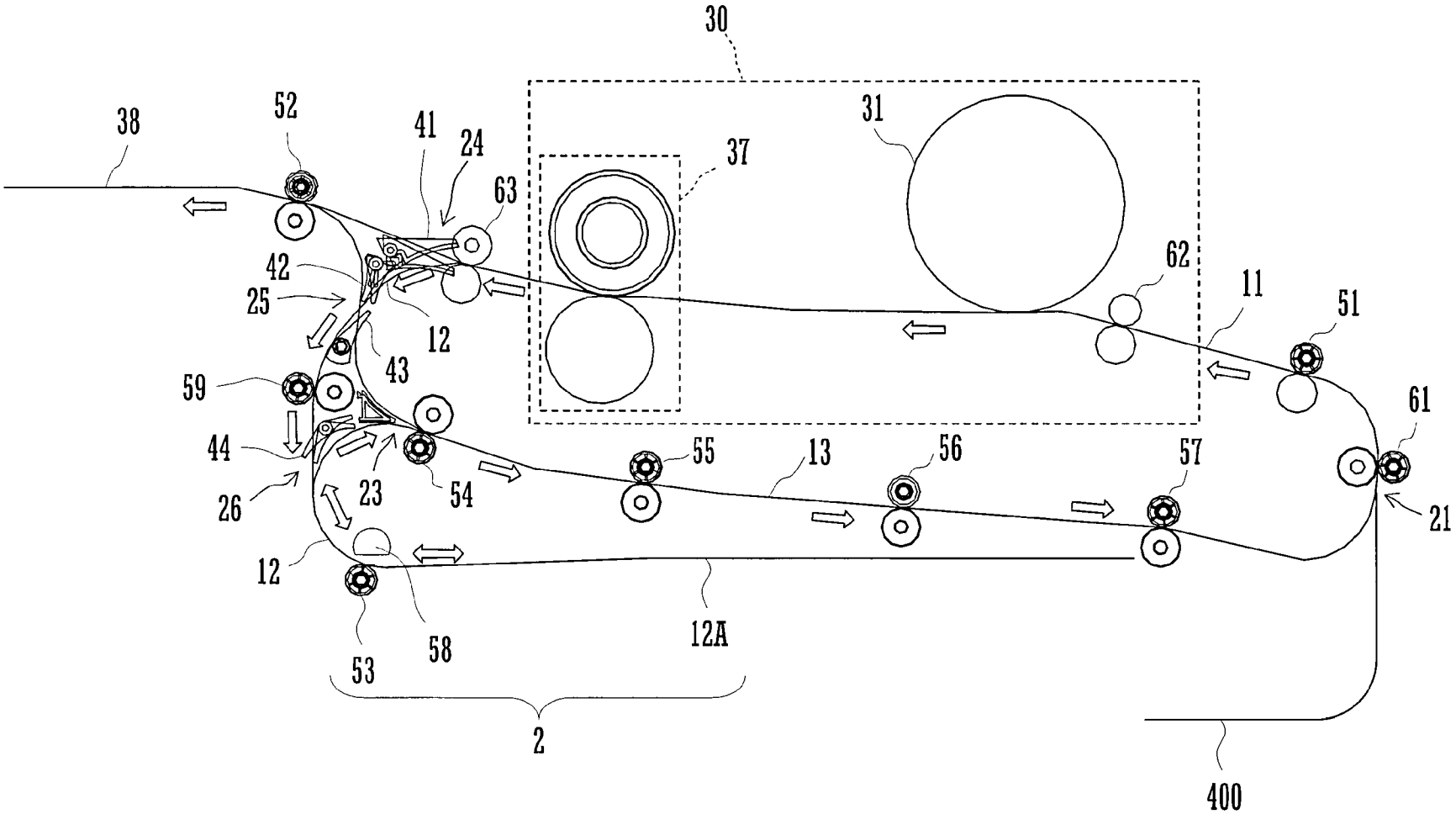
FIG. 7 is a schematic diagram illustrating an example of a second type of sheet transport operation.

FIG. 7 is a schematic diagram illustrating an example of duplex-printing transport operation. When an image is to be formed on each side of a sheet, the duplex printing operation is performed as follows. First, an image is formed on a first side of the sheet in the section 30. Next, the sheet is reversed and returned to the section 30 where an image is formed on a second side of the sheet. And finally, the sheet is output to the tray 38.

In the duplex printing operation, a sheet, after passing through the section 30, is guided from the bifurcation 24 into the path 12. Next, the sheet is switched back in the section 2 and then guided from the bifurcation 26 into the path 13. Subsequently, the sheet is guided from the path 13 into the path 11, and finally output to the tray 38 via the section 30.

The CPU 71 drives the second motor 84 through the motor driver 75 by the time a leading end of the sheet passes through the bifurcation 25. At the time, the first connecting mechanism 89 is not activated. Thus, the reversing rollers 53 and 58 are rotated in the forward directions.

Consequently, the sheet is guided from the bifurcation 24 into the path 12, and into the section 2. It is to be noted that the guide 42 is pivoted to the position indicated by the dashed line by contact with the leading end of the sheet being transported downward through the bifurcation 25, thereby allowing downward passage of the sheet along the path 12.

As the sheet is transported downward through the bifurcation 26, a tail end of the sheet becomes nipped by the reversing rollers 53 and 58. It is when the CPU 71 activates the mechanism 89 through the driver 80 and, at the same time, deactivates the solenoid 87. Further, the CPU 71 drives the motor 85 through the driver 76. At the time, the mechanism 90 is not activated. Thus, the rollers 53 and 58 are rotated in the reverse directions. Simultaneously, the rollers 54, 55, 56, and 57 are rotated in the forward directions, and the guide 44 is pivoted to the position indicated by the solid line as in FIG. 3.

With the tail end leading, the sheet is transported, upward from the section 12A, along the path 12 and is guided into the path 13 at the bifurcation 26. Next, the sheet is transported along the path 13 toward the first confluence 21. Then, the sheet is guided into the path 11 at the confluence 21, and is transported along the path 11 to the section 30 with a second side facing the drum 31.

By the time the leading end of the sheet with the second side facing upward passes through the section 30, the CPU 71 deactivates the solenoid 86. Thus, the guide 41 is pivoted to the position indicated by the solid line shown in FIG. 3. After an image is formed on the second side in the section 30, the sheet is transported through the bifurcation 24 and output to the tray 38 by the rollers 52.

Figure 8:
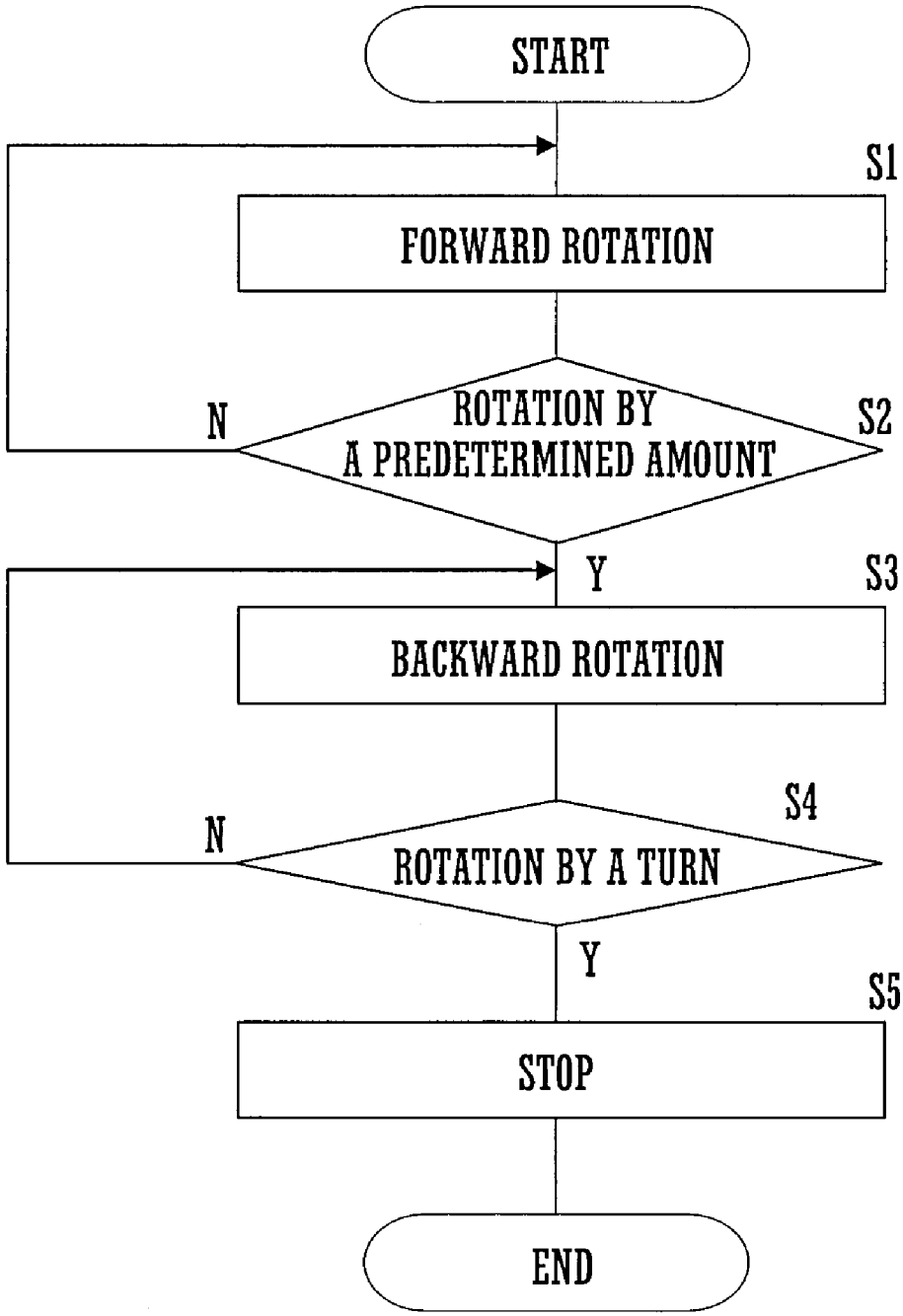
FIG. 8 is a flowchart illustrating steps of a process performed in duplex-printing operation by a CPU.
Figure 9A:
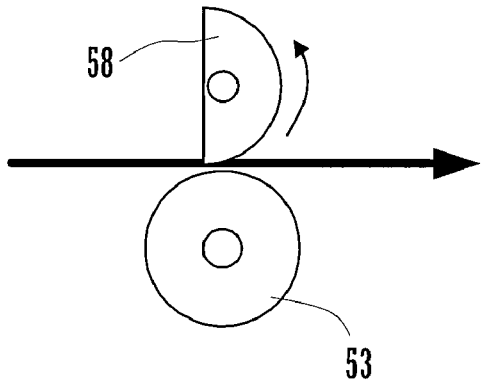
FIGS. 9A and 9E are diagrams illustrating operating conditions of a reversing roller in a switchback operation.
Figure 9B:
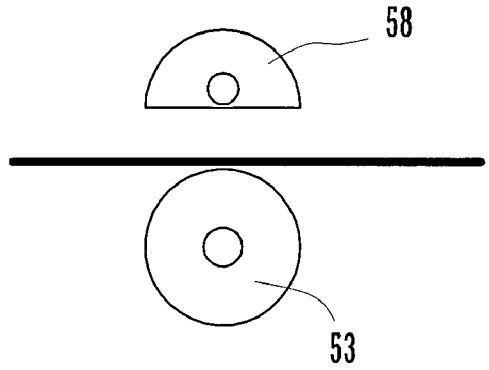

FIG. 8 is a flowchart illustrating steps of a process performed in the duplex-printing operation by the CPU 71. The CPU 71 rotates the reversing roller 58 in the forward direction in a time period between the instant when a tail end of a sheet passes between the rollers 59 and the instant when the tail end passes through the bifurcation 26 (step S1). Thus, the sheet is guided into the section 2 as shown in FIG. 9A. In the step S1, the CPU 71 controls the motor 84 and the mechanism 89 to determine the direction, and amount, of rotation of the roller 58. Next, the CPU 71 waits until the roller 58 is rotated a predetermined amount (step S2). When the roller 58 is rotated the predetermined amount, the CPU 71 determines that the tail end has passed through the bifurcation 26, and brings the roller 58 to a temporary stop as shown in FIG. 9B. When the step S2 is completed, it becomes possible to guide the sheet into the path 13, the tail end first.

Figure 9C:
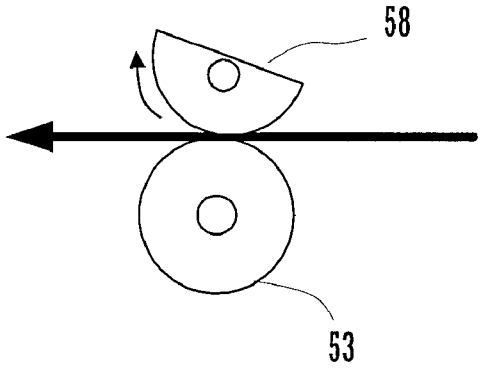
Figure 9D:
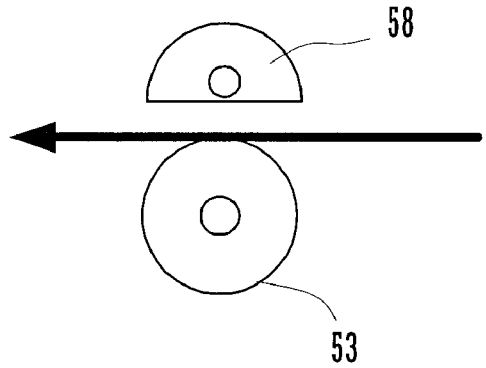

Then, the CPU 71 controls the mechanism 89 to rotate the roller 58 in the backward direction as shown in FIG. 9C (step S3). As described earlier, the circumferential length of the roller 58, excluding the length of the flat portion, is longer than the distance between the bifurcation 26 and the rollers 54. Thus, rotating the roller 58 a turn in the backward direction delivers the tail end of the sheet to the rollers 54. In the present embodiment, the CPU 71 waits until the roller 58 is rotated a turn (step S4). When the step S4 is completed, the sheet reaches such a position as to be propelled by the rollers 54.

Figure 9E:
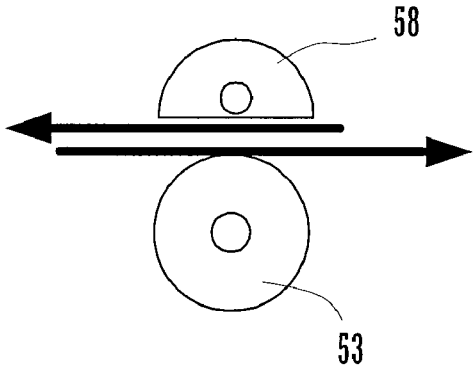

When the leading end of the sheet reaches the roller 54*s*, it becomes possible for the sheet to be ejected from the section 2 without being propelled by the rollers 53 and 58. Thus, the CPU 71 brings the roller 58 to a stop with the flat portion of the roller 58 facing the roller 53 (step S5). Thus, there is a space formed between the rollers 53 and 58 during a period of time when it is not necessary for the rollers 53 and 58 to transport a sheet. This allows a subsequent sheet to be guided into the section 2, as shown in FIG. 9E, before a preceding sheet is ejected out of the path 12A. This shortens intervals at which a series of sheets are guided into the section 2 to be successively switched back.

In the present embodiment, the roller 58 is controlled in such a manner as to apply, to a sheet, a minimum propelling force required for switching back the sheet. Thus, the space formed between the rollers 53 and 58 is maintained for a long time period. This facilitates guiding a sheet into the path 12A when a preceding sheet is ejected from the path 12A.

Figure 10:
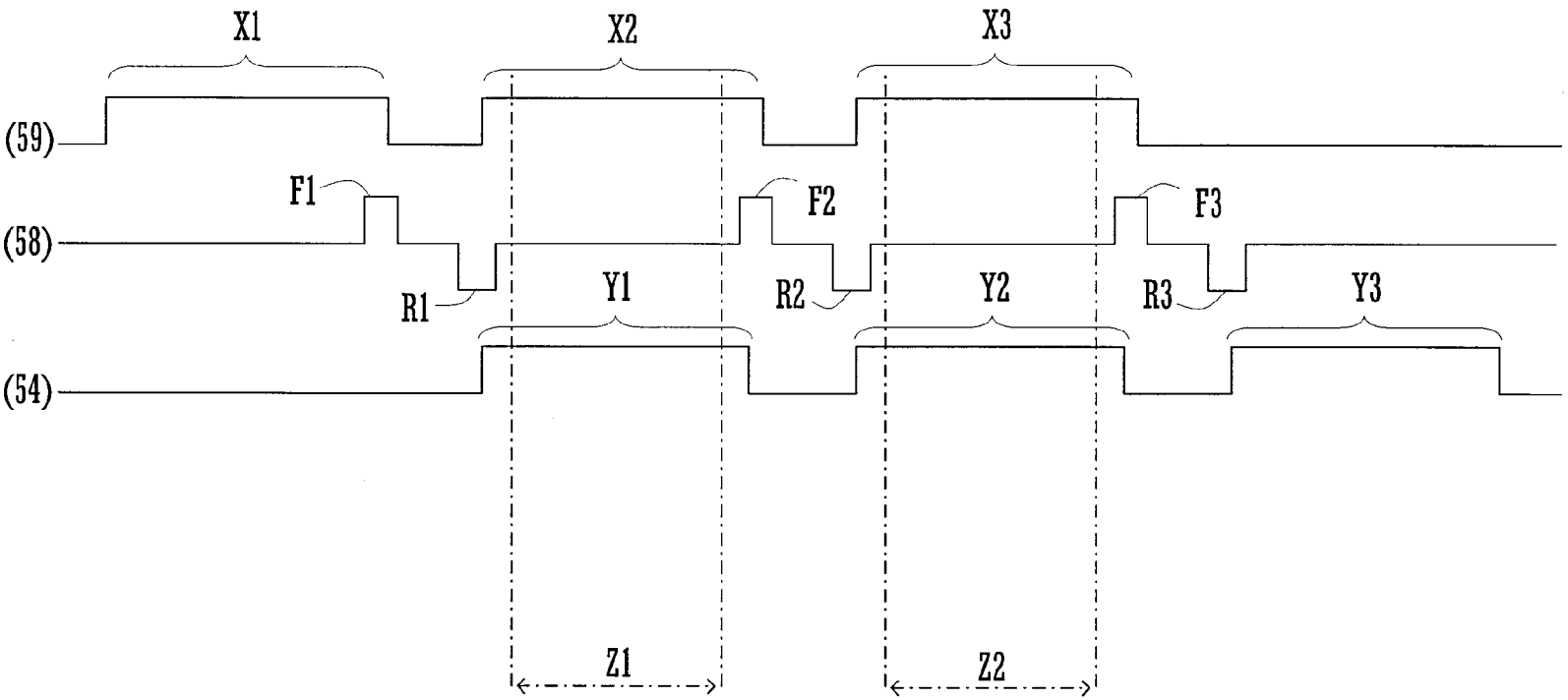
FIG. 10 is a timing chart illustrating the operating conditions of the reversing roller in the switchback operation.

FIG. 10 is a timing chart illustrating operating conditions of the transport rollers 59, the reversing roller 58, and the transport rollers 54 in a case where three sheets are successively switched back in the first switchback section 2.

In the figure, legends X1, X2, and X3 depict respective time periods when a first sheet, a second sheet, and a third sheet are being transported toward the section 2 by the rollers 59. Legends F1, F2, and F3 depict respective time periods when the first sheet, the second sheet, and the third sheet are being guided into the section 2 by rotation of the roller 58 in the forward direction. Legends R1, R2, and R3 depict respective time periods when the first, second, and third sheets are being ejected from the section 2 by rotation of the roller 58 in the backward direction. Legends Y, Y2, and Y3 depict respective time periods when the first, second, and third sheets are being transported toward the first confluence 21 by the rollers 54.

Further, legend Z1 depicts a time period when the first and second sheets are passing each other in the space between the rollers 53 and 58, and legend Z2 depicts a time period when the second and third sheets are passing each other in the space.

Thus, the space formed between the rollers 53 and 58 allow two sheets to pass each other in a single transport path. This is effective not only in the duplex-printing operation, but also in the face-down transport operation where a sheet is output face-down to the tray 38 via the section 2. Also, application of a half-moon roller to the transport rollers 54 allows sheets to pass each other also in the second switchback section.

It is to be noted that the CPU 71 may alternatively bring the roller 58 to a stop, with the flat portion of the roller 58 facing the roller 53, in a time period when at least both of the transport rollers 59 and the transport rollers 54 are being rotated, i.e., in a time period when a first sheet is being ejected from the path 12A and a second sheet immediately following the first sheet is being guided into the path 12A. Although the first and second sheets are more likely to pass each other in the path 12A in this particular time period, the space formed between the rollers 58 and 53 reduces sheet transport failures.

In addition, it is preferable that the CPU 71 controls the rollers 59 in such a manner that the second sheet is delivered to between the rollers 58 and 53 at a time when the first sheet reaches the roller 54. Such control allows a minimum interval at which the first and second sheets are guided into the section 2.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A switchback transport mechanism for switching back a sheet by guiding the sheet from a guiding path to a switchback transport path through a connecting point and then ejecting the sheet from the switchback transport path to the ejecting path through the connecting point, the switchback transport mechanism comprising:

a first transport section for applying propelling force to a sheet in the guiding path;

a second transport section for applying propelling force to a sheet in the ejecting path;

a third transport section including a first roller that has a circumferential surface with a cutout portion and a second roller placed in contact with the circumferential surface of the first roller, the first and second rollers being placed in such a manner as to be selectively attached to and detached from each other, the third transport section selectively applying propelling forces in a frontward direction and a backward direction to a sheet in the switchback transport path through the first and second rollers; and a transport control section for controlling operations of the first, second, and third transport sections, the transport control section detaching the first and second rollers from each other in a time period when no sheet is being transported by the third transport section, wherein the transport control section:

guides a sheet into the switchback transport path by rotating the first roller in a forward direction in a first time period between the instant when a tail end of the sheet in the guiding path passes through the first transport section and the instant when the tail end passes through the connecting point;

ejects the sheet out from the switchback transport path by rotating the first roller in a backward direction in a second time period between the instant when the tail end passes through the connecting point and the instant when the tail end reaches the second transport section; and brings the first roller to a stop, with the cutout portion facing the second roller, in a third time period other than the first and second time periods.

2. The switchback transport mechanism according to claim 1, wherein the transport control section detaches the first and second rollers from each other in a time period when at least both of the first and second transport sections are being activated.

3. The switchback transport mechanism according to claim 1, wherein the first roller is a half-moon roller that has a circumferential surface with a flat portion.

4. The switchback transport mechanism according to claim 3, wherein the first roller has a circumferential length, excluding length of the flat portion, longer than a distance between the connecting point and the second transport section.

5. The switchback transport mechanism according to claim 1, wherein the transport control section controls the first transport section in such a manner that, at a time when a first sheet reaches the second transport section, a second sheet immediately following the first sheet reaches the third transport section.

6. An image forming apparatus, comprising:

the switch back transport mechanism of claim 1;

a first path having a confluence connected to a most downstream portion of the ejecting path and a bifurcation connected to a most upstream portion of the guiding path, the first path guiding a sheet from a sheet feeding section through an image forming position to a sheet output section, the confluence being located upstream of the image forming position, the bifurcation being located downstream of the image forming position; and an image forming section for forming an image on a sheet being transported from the confluence to the bifurcation.

* * * * *